US005392552A

United States Patent [19]

McCarthy et al.

[11] Patent Number: 5,392,552

[45] Date of Patent: Feb. 28, 1995

[54] LIGHTED LOCKS FOR FIREARMS

[76] Inventors: Joseph McCarthy, 4035 W. Maple, Wixom, Mich. 48393; Peter A. Hochstein, 2966 River Valley Dr., Troy, Mich. 48098

[21] Appl. No.: 163,348

[22] Filed: Dec. 7, 1993

[51] Int. Cl.[6] ..... F41A 17/54

[52] U.S. Cl. ..... 42/70.07; 42/70.11; 42/70.06

[58] Field of Search ..... 42/70.01, 70.07, 70.11, 42/70.06

[56] References Cited

U.S. PATENT DOCUMENTS

| | | | |
|---|---|---|---|
| 4,499,681 | 2/1985 | Bako et al. | 42/70.07 |
| 4,959,981 | 10/1990 | Davidson | 70/238 |
| 5,022,175 | 6/1991 | Oncke et al. | 42/70.11 |
| 5,062,232 | 11/1991 | Eppler | 42/70.11 |
| 5,191,158 | 2/1993 | Fuller et al. | 42/70.07 |
| 5,283,971 | 2/1994 | Fuller et al. | 42/70.07 |

FOREIGN PATENT DOCUMENTS

| | | | |
|---|---|---|---|
| 9213249 | 8/1992 | WIPO | 42/70.11 |

*Primary Examiner*—Stephen M. Johnson
*Attorney, Agent, or Firm*—Bliss McGlynn

[57] ABSTRACT

An electronic firearm lock (10) includes a housing (18) and a locking plate (28) which are locked together rendering the trigger (12) of a firearm (16) inaccessible. The housing (18) includes a locking lever (36) which engages a sawtooth surface (34) of the locking member (32) of the locking plate (28). The lock is unlocked by entering an input code via keypad (44). The keypad (44) is illuminated prior to the pressing of any button (100) by touching two conductors (62) simultaneously by the same object, i.e., a finger allowing the operator to see the keypad (44) before the needing to begin entering an incorrect code. An alarm transducer (82) signals both when a plurality of incorrect codes are entered, indicating an unauthorized person was attempting to access the firearm (16), and when the voltage level of the battery (74) is low.

13 Claims, 3 Drawing Sheets

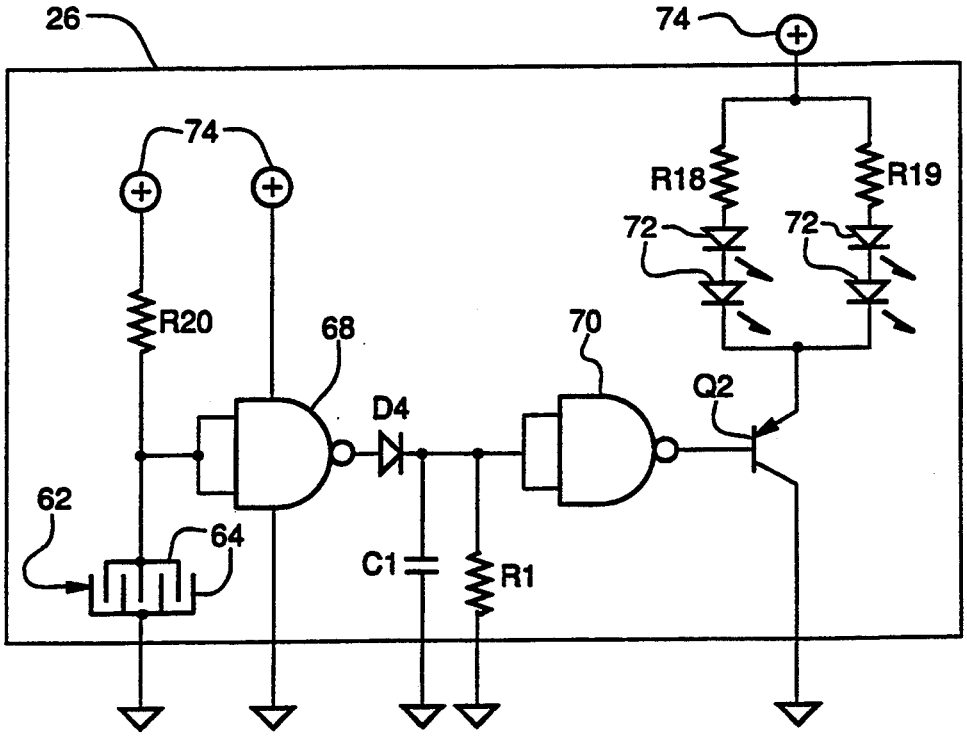
FIG - 3
FIG - 2A
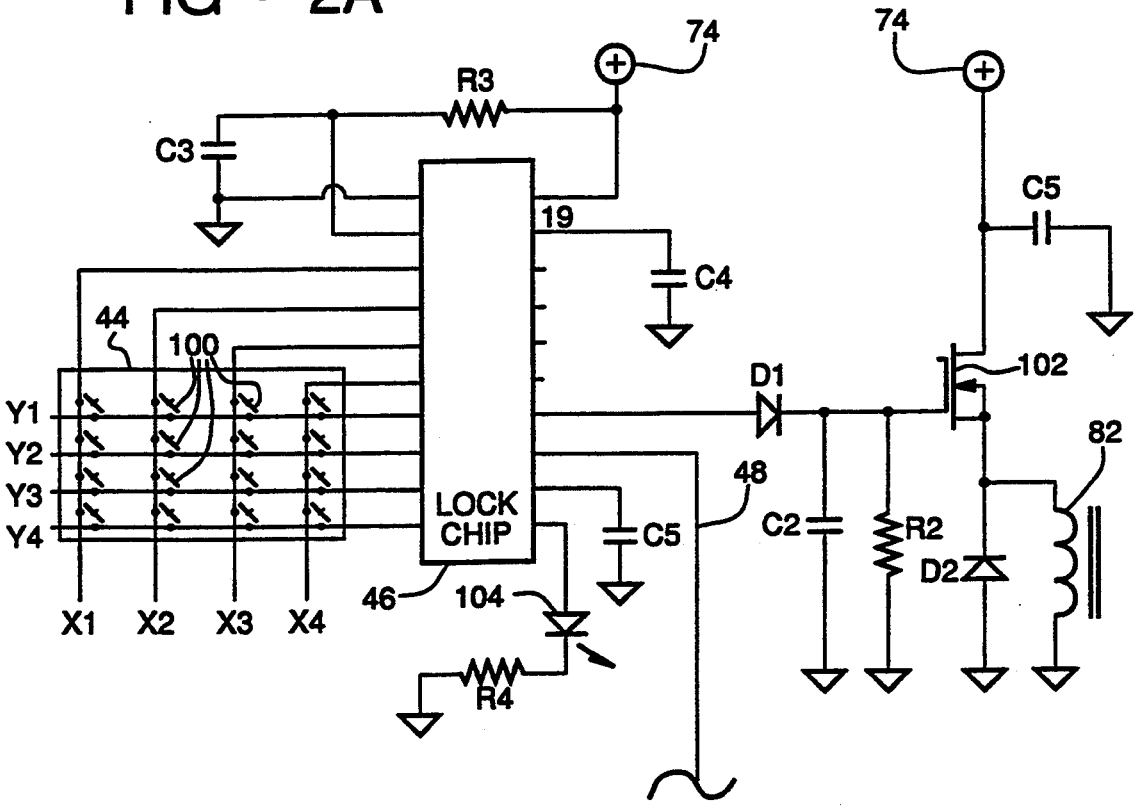

LIGHTED LOCKS FOR FIREARMS

BACKGROUND ART

1. Technical Field

The subject invention relates to trigger locks for firearms. More specifically, the subject invention relates to electronic locks preventing access to triggers of firearms.

2. Description Of Related Art

As the frequency of violent crimes occurring in residences increases, more and more civilians are purchasing handguns to defend their homes. This action, they feel, is the lesser of two evils wherein the second evil is the potential loss of life or maiming of a child. To eliminate the risk of loss of life, gun locks have been manufactured to prevent the unauthorized use of a firearm by a child.

The designs of the locking mechanisms incorporated within these gun locks are inadequate because they either require a key or enough light to view a combination or key pad lock. The disadvantage associated with the key lock is that in order for the lock to be an effective deterrent for children, the key must be stored in a remote location. Therefore, in the event an intruder is threatening bodily harm, the defender of the home must have access to two locations, i.e., where the gun is stored and where the key is stored. Likewise, in the event of an intruder threatening bodily harm at night, a combination lock is ineffective because the defender must turn on a light to see the combination lock which could destroy the defender's element of surprise.

U.S. Pat. No. 5,062,232, issued to Eppler on Nov. 5, 1991, discloses a safety device for firearms wherein an electronic lock is incorporated into the handle of the firearm and prevents the trigger from being pulled. To unlock the firearm, the operator of the firearm must be wearing a glove with a signal generator affixed to the palm of the glove. Although this assembly adequately eliminates the need for a light to unlock the safety device, the operator still needs access to the location where the glove is stored that location being different than the location of the gun to insure the safety of the members of the household. Further, the operator must successfully put the glove on the hand before the safety device will unlock the trigger. Additionally, a problem occurs when the operator of the gun is not the owner, yet authorized, but does not shoot the firearm with the same hand.

U.S. Pat. No. 5,022,175, issued to Oncke et al on Jun. 11, 1991, discloses a safety device for a firearm wherein a key pad is located at the base of the handle wherein the correct combination unlocks the trigger allowing an operator to use the firearm. The deficiencies associated with this safety lock include the requirement of a light to successfully enter the proper unlocking code and, as with the safety device discussed above, a special gun must be purchased because the lock is incorporated into the handle of the firearm. Two light emitting diodes (LED) are on the face of the keypad but merely indicate whether the gun is locked or 10 unlocked and do not illuminate the key pad sufficiently for the use thereof.

U.S. Pat. No. No. 4,959,981, issued to Davidson on Oct. 2, 1990, discloses a security lock for a vehicle including an illuminator. The illuminator extends along an elongated member which is hooked to the vehicle steering assembly. The illuminator is a beacon for would-be thieves and deters the thieves from initially entering the vehicle. More specifically, when a thief approaches the car, the illuminator can be seen which will deter the thief from performing an initial invasive act such as breaking a window or destroying the paint finish of a car trying to unlock the door lock. An illuminator such as this would not be proper when used with a firearm because the target of the firearm would know exactly where the operator of the firearm was located if the surrounding environment were dark.

Therefore, there remains a deficiency in the art of gun locks for a gun lock which can be stored and accessed from a single location and, at the same time, be used at night or in the dark.

SUMMARY OF INVENTION AND ADVANTAGES

The subject invention is a firearm locking assembly for preventing unauthorized access to a trigger within a trigger guard of a firearm. The firearm locking assembly comprises a housing defining an enclosure and includes an aperture. The subject invention further includes a locking plate defining a plane which is matingly engageable with the housing such that the housing and the locking plate matingly engage on either side of the trigger and the trigger guard of the firearm. Locking means locks the locking plate to the housing. Unlocking means unlocks the locking plate from the housing. The unlocking means includes an input receiving means for receiving an input code. The firearm locking assembly is characterized by illuminating means for illuminating input receiving means to input the input code correctly into the input receiving means when the surrounding environment is darkened.

The advantage associated with the subject invention includes the ability to prevent access to a firearm by unauthorized users while maintaining the ability to access the firearm by accessing only the location of the firearm while eliminating the need to provide a light to view the lock to disarm the lock.

BRIEF DESCRIPTION OF THE DRAWINGS

Other advantages of the present invention will be readily appreciated as the same becomes better understood by reference to the following detailed description when considered in connection with the accompanying drawings wherein:

FIGS. 2A and 2B are partial schematic views of the preferred embodiment of the subject invention; and FIG. 3 is a partial schematic of the preferred embodiment of the subject invention.

DETAILED DESCRIPTION OF THE DRAWINGS

Figure 1:
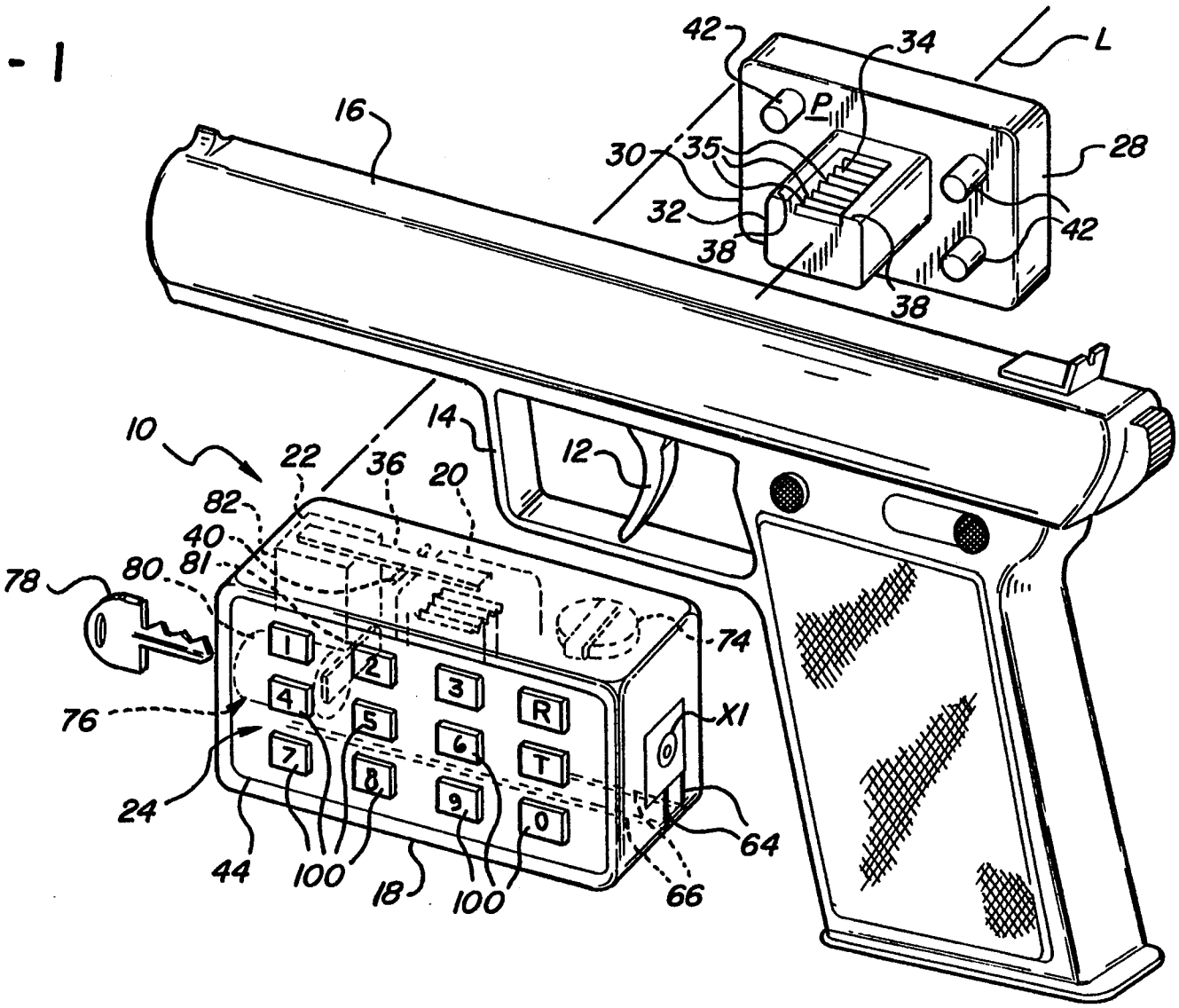
FIG. 1 is an exploded perspective view of the preferred embodiment of the subject invention around a firearm.

Turning to FIG. 1, a firearm locking assembly is generally indicated at 10. The firearm locking assembly 10 prevents unauthorized access to a trigger 12 located within a trigger guard 14 of a firearm 16. The firearm 16 in FIG. 1 is shown to be a hand gun. It is, obvious, to those skilled in the art that the subject assembly 10 may be used with any firearm which includes a trigger 12 which is surrounded by a trigger guard 14.

A housing 18 defines an enclosure and includes an aperture 20 (shown in phantom) and houses the locking means, generally indicated at 22, the unlocking means, generally at 24, and the illuminating means 26 (shown in FIG. 3), all of which will be discussed subsequently.

A locking plate 28 is matingly engageable with the housing 18 such that the housing 18 and the locking plate 28 matingly engage on either side of the trigger 12 and the trigger guard 14 of the firearm 16. The locking plate 28 defines a plane P along the inner surface 30 of the locking plate 28. The locking plate 28 includes a locking member 32 away from the locking plate 28. The locking member 32 defines a longitudinal axis L which is substantially perpendicular to the plane P of the locking plate 28. The locking member 32 is selectively extendable into the aperture 20 of the housing 18. The locking member 32 further includes a sawtooth surface 34 comprising a plurality of triangular teeth 35.

The locking means 22 locks the locking plate 28 to the housing 18. The locking means 22 includes a lever 36 which is biased to engage the sawtooth surface 34 of the locking member 32 when the locking member 32 enters to housing 18 through the aperture 20. The lever 36 includes at least one tooth (not shown) which extends below the lever 36 so it may engage the sawtooth surface 34 of the locking member 32 which is recessed from two side surfaces 38 of the locking member 32. Once the locking-member 32 is inserted into the aperture 20, the lever 36 must be rotated about a pin 40 so that the tooth of the lever 36 disengages the sawtooth surface 34 of the locking member 32 so that the housing 18 and the locking plate 28 may be separated providing access to the trigger 12 of the firearm 16.

The locking plate 28 further includes spring loaded pins 42 which also extend out perpendicularly from the plane P defined by the inner surface 30 of the locking plate 28. The spring loaded pins 42 abut the housing 18 when the locking plate 28 is locked with the housing 18. The spring loaded pins 42 prevent the firearm locking assembly 10 from shifting relative to the trigger guard 14 once the firearm locking assembly 10 is locked into position. The spring loaded pins 42, or other such types of spacing apparatus, are necessary to prevent the firearm locking assembly 10 from shifting relative to the trigger guard 14. If such a shift occurs, the locking member 32 may potentially move the trigger 12 and fire the firearm 16.

The unlocking means 24 unlocks the unlocking plate 28 from the housing 18. The unlocking means 24 includes input receiving means 44 for receiving an input code. The input receiving means 44 includes a keypad 44 electronically connected to the unlocking means 24. The keypad 44 may include any commercially available keypad. In the preferred embodiment, however, the keypad is a standard 3×4 matrix which utilizes an L.S.I. type LS7222 lock chip 46. The keypad 44 is the data entry device for the lock chip 46.

In normal operation, the lock chip 46 will develop an output whenever the correct series of digits is entered in the right sequence, i.e., the input code. Erroneous entries are detected and are routed to a "tamper output" pin 48. Typically, if the tamper output pin 48 is high, an alarm 50 would sound. However, because the subject invention 10 is going to be used in stressful situations or in times of panic wherein an authorized user of the firearm 16 may inadvertently enter the wrong code, i.e., an erroneous entry, a tamper counter chip 52 is used to count the number of times an incorrect input code is entered. The tamper counter chip 52 is a CMOS CD4017B decade counter and allows up to nine incorrect input codes to be entered before the alarm is sounded. As shown in FIG. 2, the tamper counter chip 52 will allow two incorrect entries before the trigger switch Q1 triggers the set/reset latch 54. Once set, the set/reset latch 54 enables the alarm sound generator circuit 56 to drive the Piezo siren or sound generator X1. The sound generator X1 incorporates a standard oscillator that develops a 1.5 kilohertz square wave modulated by the 12 Hertz oscillator 58. The sound generator X1 can only be turned off by resetting the set/reset latch 54 by means of an alarm reset switch 60 which is located on the housing 18 on the surface which faces the trigger guard 14 and locking plate 28 making the switch 60 inaccessible to those that cannot unlock the firearm locking assembly 10. Therefore, when children are attempting to access the firearm 16, they cannot just reset the sound generator circuit 56 and start over.

Illuminating means 26 illuminates the input receiving means 44 to input the input code correctly into the input receiving means 44 when the surrounding environment is darkened. The illuminating means 26 may include one or more LEDs 72 directed at the keypad 44 to illuminate the keypad and any alphanumeric symbols attached thereto. In the preferred embodiment, the illuminating means 26 will backlight the keypad 44.

Switching means 62 turns on the illuminating means 26 prior to using the input receiving means 44. The switching means 62 allows illumination of the keypad 44 to occur prior to the pressing of any buttons on the keypad 44 to maximize the number of real attempts to unlock the firearm locking assembly 10 prior to the activation of the sound generator X1. The switching means 62 includes at least one touch sensor 62 fixedly secured to the housing 18 allowing an operator to illuminate the illuminating means 26 by touching the housing 18. In the preferred embodiment, the switching means 62 includes two conductors each extending around the periphery of the housing 18 in their respective recessed channels 66. The conductors 64 are spaced apart and electrically isolated from each other and recessed within the housing 18 to prevent damage thereto. However, the conductor 64 are not separated too far nor recessed too deeply such that when the operator touches the channel 66, the skin of the operator will physically contact each of the conductors 64 closing the circuit 62 which for a predetermined period of time the LEDs 72 will illuminate the keypad 44.

As shown in FIG. 3, a quad Schmitt NAND gate 68 is connected so that the normal skin resistance applied across the conductors 64 of the Schmitt NAND gate 68 from low to high, thereby charging the timing compactor C1 at the input of the second NAND gate 70. The second NAND gate 70 drives the PNP emitter follower Q2 into conduction for a duration of timing period established by the RC constant at the input of the NAND gate 70, created by the capacitor C1 and a resistor R1 connected in parallel. The transistor Q2 only energizes the LEDs 72 during the timing period, typically four seconds, keeping the keypad 44 lit as long as it is being held. The capacitor C1 and resistor R1 have values to allow the LEDs 72 to remain at a constant brightness without flicker in spite of intermittent or erratic hand contact with the housing 18 and the embedded conductors 64.

A power supply 74 is electrically connected to the unlocking means 24 to supply electric potential to the firearm locking assembly 10. The power supply 74 is a nine volt battery and may be any standard battery designed to power small electronic devices.

If the power supply 74 becomes so depleted that the unlocking means 24 is no longer operable, the unlocking means further includes manual unlocking means, generally indicated at 76, for unlocking the firearm locking assembly 10. The manual unlocking means 76 includes a key 78 which is insertable into a key lock 80 within the housing 18. Once the key 78 is inserted into the key lock 80, the key 78 is rotated which will pivot a key lever 81 which is connected to the lever 36 which will lift the lever 36 away from the sawtooth surface 34 allowing the firearm locking assembly 10 to be accessed and, at the same time, allowing access to the battery cavity in the housing 18 to replace the battery 74.

The unlocking means 24 further includes a solenoid 82 for moving the lever 36 out of engagement with the sawtooth surface 34 of the locking member 32. The solenoid 82 is activated when the input receiving means 44 receives the proper input code. The solenoid 82 is connected to the locking chip 46 at pin 14 through a MOSFET transistor 102 whose base is connected to the pin 14 through diode D1, having a resistor R2 and capacitor C2 tied in parallel between the diode D1 and the base of the MOSFET transistor 102. The MOSFET transistor 102 is connected in source follower configuration. The RC times constant, dictated by the resistor R2 and capacitor C2 allows the solenoid 82 to remain energized for several seconds after the momentary unlock from the locking chip 46 has ended. This allows ample time to unlock the firearm locking assembly 10 preventing unnecessary stress in a given situation.

Low power indicating means 84 signals when the power supply 74 is low. The low power indicating means 84 includes a second alarm circuit 84 which is modulated to provide a low frequency "chirp" oscillation created by a low frequency oscillator 86. A low battery voltage detection circuit, including a standard micropower integrated circuit 88 signals when the battery voltage of the battery 74 drops below a certain preset voltage, approximately 6.5 Volts in the preferred embodiment. A chirp oscillator enabled by the transistor Q2 begins to cycle the alarm oscillator 86 at a slow 0.1 Hertz rate. The same sound generator X1 is used and will chirp for about 0.25 seconds every ten seconds indicating a low battery voltage.

Figure 2B:
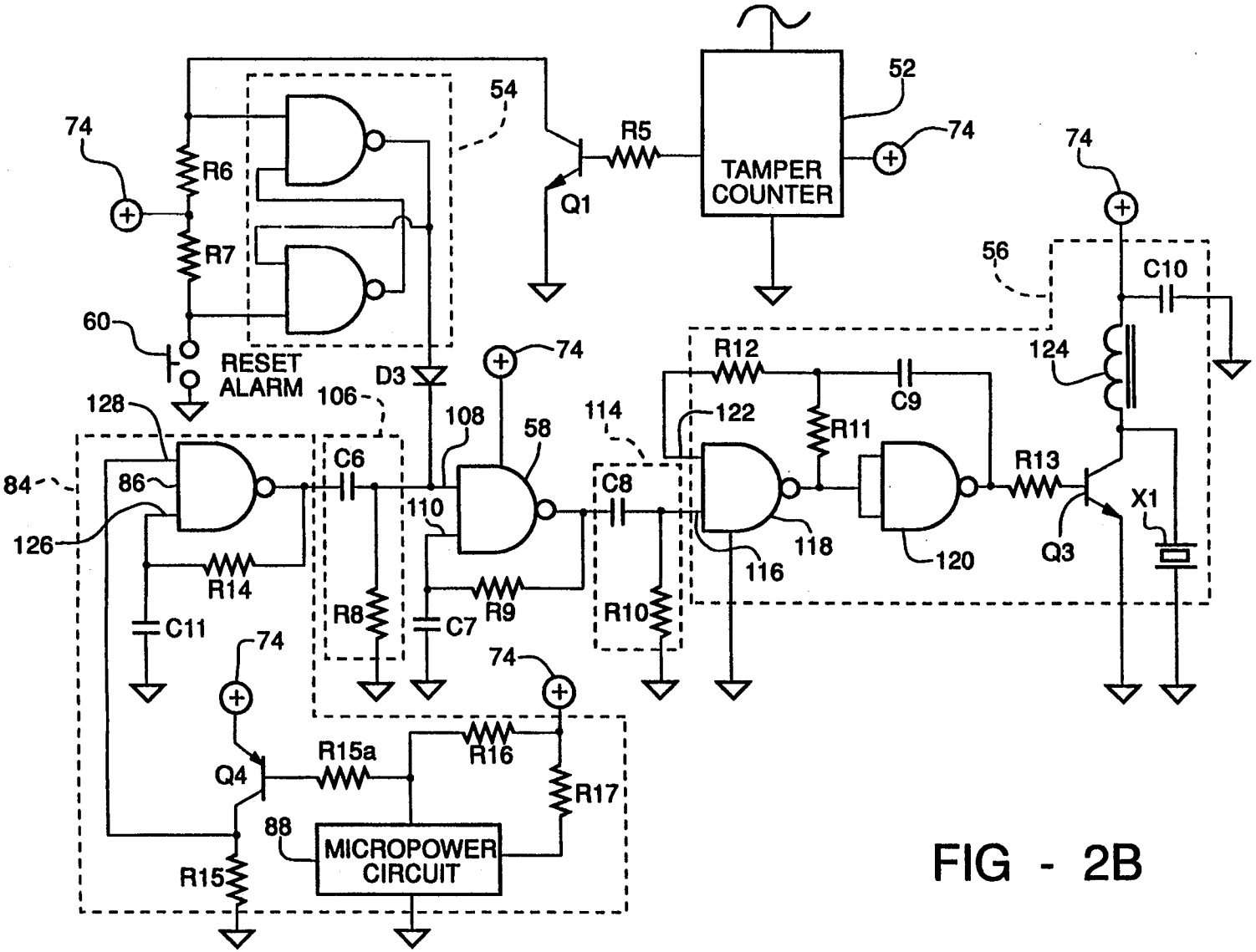

Turning to FIGS. 2A, 2B and 3, an encircled positive symbol represents a common connection to the positive terminal of a nine Volt battery 74. The lock chip 46 is connected to the positive terminal at the pin 20. Pin 2 and pin 1 are also connected to the battery 74 through a resistor R3 and a capacitor C3 respectively. Pins 3–10 of the lock chip 46 are connected to the keypad 44 wherein a combination of each of the pins will go high depending on which button 100 is being pressed. Pin 18 is connected to ground through a capacitor C4. The MOSFET transistor 102 is connected to the battery 74 in parallel with a capacitor C5. The follower terminal of the transistor 102 includes a diode D2 and the solenoid 82 which are also connected to ground. A capacitor C5 is connected to pin 12 of the lock chip 46 and ground whereas an LED 104 and a resistor R4 are connected in series between pin 11 and ground. The tamper counter chip 52 is a CD 4017B chip and pin 14 thereof is connected to pin 13 of the lock chip 46. Pin 16 is connected to the battery 74 and pins 8, 13 and 15 are connected to ground. Pin 9 of the tamper counter 52 is connected to the base of transistor 21 through a resistor R5. The collector of the transistor Q1 is connected to the set/reset latch 54 and the emitter of transistor Q1 is connected to ground. Two inputs of the set/reset latch 54 are also connected to the battery 74 through resistors R6 and R7, respectively. The input of this set/reset latch 54 is also connected to ground through the reset alarm switch 60. The output of the set/reset latch 54 is connected through diode to the alarm circuits 56, 84. The diode D3 is connected to a coupler 106, including a capacitor C6 and resistor R8, and one of the inputs for the oscillator circuit 58. The second input 110 and the output 112 of the oscillator circuit 58 are connected through a resistor R9 and through a capacitor C7 to ground. A second coupler 114 includes a resistor R10 and a capacitor C8, the output of which is connected to the input of the alarm means 56. The alarm means 56 includes an oscillator created by NAND gates 118, 120 wherein the output of the first NAND gate 118 is connected to the second input 122 of the NAND gate 118 through resistors R11, R12 and both inputs of the second NAND gate 120. The output of the second NAND gate 120 is connected to the input of the second NAND gate 120 through capacitor C9 and resistor R11. Further, the output of the second NAND gate 120 is connected to the base of a transistor Q3 through resistor R13. The emitter of the transistor Q3 is connected to ground whereas the collector of the transistor Q3 is connected in parallel to the sound generator X1 and an inductor 124. The inductor is connected to the battery 74 and a capacitor C10 which is also connected to ground.

The first coupler 106 is also connected to the low power indicating means 84. The output of the low frequency chirp oscillator 86 is connected to the coupler 106 and the first input 126 of the low frequency chirp oscillator 86 through a resistor R14. The first input 126 is also connected to ground through capacitor C11. The second input 128 of the low frequency chirp oscillator 186 is connected to the emitter of a transistor Q4 wherein the collector of the transistor Q4 is connected to the battery 74. The emitter of the transistor Q4 is connected to ground through a resistor R15. The base of the transistor Q4 is connected to the first pin of the micropower integrated circuit 88, as well as the battery 74 through a resistor **R15*a*. The second pin of the micropower integrated circuit 88 is also connected to the battery 74 through resistor R17 which, in turn, is also connected to the resistor R16. The third pin of the micropower integrated circuit 88** is connected to ground.

Turning our attention to FIG. 3, the four LEDs 72, two pairs in series connected to the battery 74, each pair of LEDs 72 connected to the battery through a resistor R18 and resistor R19, respectively. Both pairs of LEDs 72 are connected to the collector of the second transistor Q2. The emitter of the transistor Q2 is connected to ground and the base of the transistor Q2 is connected to the output of the NAND gate 70. The inputs of the NAND gate 70 are connected to resistor R1 and capacitor C1 which create the time constant which drives the LEDs 72. The capacitor C1 and resistor R1 are connected to ground and also to diode D4 which, in turn, is connected to the output of NAND gate 68. The inputs of which are connected to the battery 74 through resistor R20 and the two conductors 62. The conductors 62 are also connected to ground are insulated from each other. Both are touched by a single element with sufficient conductivity to complete the circuit.

The method for unlocking the trigger 12 of a firearm 16 locked within an electronic lock 10 having a keypad 44 for entering a combination includes the steps of entering a predetermined code into the keypad 44. The method is characterized by illuminating the keypad 44 so the operator may see the keypad before attempting to enter the predetermined code into the electronic lock 10. The method is further characterized by touching the electronic lock 10 to illuminate the keypad 44. By merely touching the electronic lock 10 and not the keypad 44, the operator is enabled to see the keypad 44 before touching it and potentially entering an erroneous code.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

We claim:

1. A firearm locking assembly (10) for preventing unauthorized access to a trigger (12) located within a trigger guard (14) of a firearm (16), said firearm locking assembly (10) comprising:

a housing (18) defining an enclosure having aperture (20);

a locking plate (28) defining a plane (P) and including a locking member (32) extendable behind the trigger (12), said locking plate (28) matingly engageable with said housing (18) such that said housing (18) and said locking plate (28) matingly engage on either side of the trigger (12) and the trigger guard (14) of the firearm (16);

locking means (22) for locking said looking plate (28) to said housing (18);

unlocking means (24) for unlocking said locking plate (28) from said housing (18), said unlocking means (24) including input receiving means [(40)]44 for receiving an input code, said firearm locking assembly (10) characterized by illuminating means (26) for illuminating said input receiving means (44) to input said input code correctly into said input receiving means (44).

2. An assembly (10) as set forth in claim 1 further characterized by switching means (62) for turning on said illuminating means (26) prior to using said input receiving means (44).

3. An assembly (10) as set forth in claim 2 further characterized by said switching means (62) including at least one touch sensor (62) fixedly secured to said housing (18) allowing an operator to illuminate said illuminating means (26) by touching said housing (18).

4. An assembly (10) as set forth in claim 3 further characterized by said input receiving means (44) including a keypad (44) electronically connected with said unlocking means (24).

5. An assembly (10) as set forth in claim 4 further characterized by a power supply (74) electrically connected to said unlocking means (24) to supply electric potential to said firearm locking assembly (10).

6. An assembly (10) as set forth in claim 5 further characterized by said unlocking means (24) further including a manual unlocking means (76) for unlocking said firearm locking assembly (10) when said power supply (74) is depleted.

7. An assembly (10) as set forth in claim 6 further characterized by said locking plate (28) including a locking member (32) for extending out and away from said locking plate (28) substantially perpendicular to said plane (P) and selectively extendable into said aperture (20) in said housing (18), said locking member (32) including a sawtooth surface (34).

8. An assembly (10) as set forth in claim 7 further characterized by said locking means (22) including a lever (36) biased to engage said sawtooth surface (34) of said locking member (32) as said locking member (32) enters said housing (18) through said aperture (20).

9. An assembly (10) as set forth in claim 8 further characterized by said unlocking means (24) including a solenoid (82) for moving said lever (36) out of engagement with said sawtooth surface (34) upon said input receiving means (44) receiving said input code.

10. An assembly (10) as set forth in claim 9 further characterized by low power indicating means (84) for signaling when said power supply (24) is low.

11. An assembly (10) as set forth in claim 10 further characterized by alarm means (56) for producing an alarm signal after said input receiving means (44) receives a plurality of incorrect input codes.

12. A firearm locking assembly (10) for preventing unauthorized access to a trigger (12) located within a trigger guard (14) of a firearm (16), said firearm locking assembly (10) comprising:

a housing (18) defining an enclosure having aperture (20);

a locking plate (28), defining a plane(P) and including a locking member (32) extendable behind the trigger (2), said locking plate (28) matingly engageable with said housing (18) Such that said housing (18) and said locking plate (28) matingly engage on either side of the trigger (12) and the trigger guard (14) of the firearm (16);

a lock (22) for locking said locking plate to said housing (18);

an unlocking mechanism (24) for unlocking said locking plate (28) from said housing (18), said unlocking mechanism (24) including a keypad (40) for receiving an input code, said firearm locking assembly (10) characterized by an illuminator (6) directed at said keypad (44) for illuminating said keypad (44) to input said input code correctly into said keypad (44).

13. A method for unlocking a trigger (12) of a firearm (16) locked within an electronic lock (10) having an illumination source (26) and keypad (44) for entering a combination, the method comprising the steps of:

activating the illumination source (26) to illuminate the keypad (44);

entering a predetermined code into said keypad (44); and pulling the electronic lock. (10) apart to access said trigger (12) of said firearm (16).

* * * * *